US012702217B2

(12) United States Patent
Kirszbaum et al.

(10) Patent No.: US 12,702,217 B2
(45) Date of Patent: Aug. 11, 2026

(54) DEVICE FOR ASSISTING THE DORSAL CARRYING OF A BACKPACK- OR SATCHEL-TYPE BAG

(71) Applicants: Guillaume Gregory Sebastien Kirszbaum, Paris (FR); Alexandre Kirszbaum, Paris (FR)

(72) Inventors: Guillaume Gregory Sebastien Kirszbaum, Paris (FR); Alexandre Kirszbaum, Paris (FR)

( * ) Notice: Subject to any disclaimer, the term of this patent is extended or adjusted under 35 U.S.C. 154(b) by 38 days.

(21) Appl. No.: 18/674,865

(22) Filed: May 26, 2024

(65) Prior Publication Data

US 2024/0306800 A1 Sep. 19, 2024

Related U.S. Application Data

(63) Continuation-in-part of application No. 17/626,085, filed as application No. PCT/EP2020/069773 on Jul. 13, 2020, now abandoned.

(30) Foreign Application Priority Data

Jul. 11, 2019 (FR) ..... 1907808

(51) Int. Cl.
*A45F 3/14* (2006.01)
*A45F 3/04* (2006.01)

(52) U.S. Cl.
CPC ..... *A45F 3/14* (2013.01); *A45F 3/04* (2013.01); *A45F 2003/045* (2013.01); *A45F 2003/142* (2013.01)

(58) Field of Classification Search
CPC ..... A45F 3/14
USPC ..... 224/257, 578, 153
See application file for complete search history.

(56) References Cited

U.S. PATENT DOCUMENTS 995,458 A * 6/1911 Harriman ..... A45F 5/00 224/645
4,506,769 A * 3/1985 Franco ..... A45C 13/02 190/110
5,101,768 A * 4/1992 Cates ..... A62B 35/0006 224/160
5,205,448 A 4/1993 Kester et al.
5,333,768 A * 8/1994 Krentz ..... A45F 5/00 224/640
5,579,966 A * 12/1996 Krumweide ..... A45F 3/08 294/157

(Continued)

*Primary Examiner* — Nathan J Newhouse
*Assistant Examiner* — Lester L Vanterpool
(74) *Attorney, Agent, or Firm* — H&I PARTNERS; Chai Im; C. Andrew Im

(57) ABSTRACT

A device to assist the dorsal carrying of a backpack-type or satchel-type bag by an individual, such as a child or a teenager. The bag includes a pair of shoulder straps. The dorsal carry assist device includes a carrying sling to carry the bag and a retaining sling. The carrying sling clasps a portion of the bag and the hips of the individual, without clasping the bag entirely. The retaining sling removably retains the carry sling to the bag and includes a fastener to open and close the retaining sling. When the retaining sling is closed, the retaining sling forms together with a central portion of the carry sling a loop which is configured to clasp entirely a lower portion of the bag when it is carried according to a carry axis. The dorsal carry assist device preferably includes a stabilizing sling configured to stabilize the bag.

14 Claims, 5 Drawing Sheets

(56) References Cited

U.S. PATENT DOCUMENTS

| | | | | | |
|---|---|---|---|---|---|
| 5,790,981 | A * | 8/1998 | Bzoch | A41D 13/0568 | 2/22 |
| 5,927,576 | A | 7/1999 | Nielsen | | |
| 5,984,157 | A * | 11/1999 | Swetish | A45F 3/10 | 224/641 |
| 6,024,265 | A * | 2/2000 | Clements | A45F 3/04 | 224/259 |
| 6,179,187 | B1 * | 1/2001 | Lemire | A45F 3/04 | 224/628 |
| 6,193,293 | B1 * | 2/2001 | Ybanez | B65G 7/12 | 294/157 |
| 8,998,045 | B2 * | 4/2015 | Cartwright | A45F 3/12 | 224/264 |
| 2003/0102342 | A1 * | 6/2003 | Fogg | A45F 5/02 | 224/259 |
| 2007/0246493 | A1 | 10/2007 | Kernkamp | | |
| 2013/0199457 | A1 * | 8/2013 | Frasier | B68C 1/20 | 119/496 |
| 2015/0157115 | A1 * | 6/2015 | Smith | A45F 3/08 | 224/633 |
| 2016/0100671 | A1 * | 4/2016 | Zets | A45C 11/20 | 224/250 |
| 2016/0338474 | A1 * | 11/2016 | Colvin | A45F 3/12 | |
| 2020/0205557 | A1 * | 7/2020 | White, Jr. | A63C 17/0006 | |
| 2021/0330975 | A1 * | 10/2021 | Davis | A61N 1/0541 | |
| 2022/0015552 | A1 | 1/2022 | Straub | | |

* cited by examiner

DEVICE FOR ASSISTING THE DORSAL CARRYING OF A BACKPACK- OR SATCHEL-TYPE BAG

RELATED APPLICATIONS

This application is a continuation-in-part application of Ser. No. 17/626,085 filed Jan. 10, 2022, which is a § 371 application of PCT/EP2020/069773 filed Jul. 13, 2020, which claims priority from French Patent Application No. 19 07808 filed Jul. 11, 2019, each of which is incorporated herein by reference in its entirety

TECHNICAL FIELD OF THE INVENTION

The field of the invention is that of luggage.

More specifically, the invention relates to a device for assisting the dorsal carrying of a backpack- or satchel-type bag.

In particular, the invention finds applications for assisting an individual such as a child or a teenager to carry on his back a bag that weighs a significant weight, greater than the usual recommendation setting the maximum weight of a bag at 10% of the weight of such individuals.

BACKGROUND OF THE INVENTION

Carrying a heavy bag on a regular basis may turn out to be tedious, and even tricky during an individual's growth period.

The overweight of school bags, which often weigh 20% of the children or teenagers who carry them between their homes and an educational institution, is also a real public health problem. Indeed, carrying such bags might cause deformations in the skeleton, respiratory compressions, and even scolioses or lumbagos.

In order to remedy this, it is known from the prior art techniques for assisting the carrying of a backpack- or satchel-type bag.

Thus, there are techniques for rolling the bag which is then no longer carried but pulled.

Nonetheless, these techniques are barely satisfactory. Besides the noise generated by the rolling of such a bag, these techniques have the drawback of causing imbalances at the level of the spine. Indeed, such bags are pulled with an arm which is stretched backwards. Such bags are also lifted on a regular basis in order to climb a step or a staircase, which is barely practical and could lead to trauma at the level of the shoulder.

Besides, it should be pointed out that this type of wheeled bag has been banned by some schools, which recommend that their students use a bag carried on the back.

To assist the dorsal carrying of a bag, rigid frames that could be carried by an individual on his back have in particular been developed. These frames are configured to relieve a portion of the weight of a backpack that is brought to rest on an inclined platform of the frame.

Nonetheless, these frames are bulky and even unsightly, making them difficult to use in a school environment.

In order to reduce the bulk of such techniques, there are belts including a platform forming a stop on which the backpack is brought to rest.

Nonetheless, these belts have the drawback of not holding the bag during the movements of the individual who might thus be unbalanced if the bag slips off the platform.

None of the current systems allow simultaneously meeting all of the required needs, namely providing a technique for assisting the dorsal carrying of a backpack- or satchel-type bag which is removable and compactable so that it could be easily stored, practical to use in a school environment, i.e. without hindering the common use of such a bag, and which allows effectively relieving the shoulders of a carrier of such a bag by keeping the bag substantially parallel to the back of the carrier.

SUMMARY AND OBJECT OF THE INVENTION

The present invention aims to overcome all or part of the drawbacks of the aforementioned prior art.

To this end, the invention relates to a device for assisting the dorsal carrying of a backpack- or satchel-type bag by an individual, said bag including a pair of shoulder straps.

It is to be noted that the device is removable from the bag, i.e., the device can be placed or mounted onto the bag anytime it is needed, and removed when it is no longer needed. In particular, the device is suitable for any type of backpack or satchel type bag having shoulder straps.

It should be pointed out that when carrying such a bag on the back by the individual, each shoulder strap bears on a distinct shoulder of the individual. The bag is then generally oriented according to an axis parallel to the back of the individual. This axis is substantially vertical when the individual stands upright. This axis shall subsequently be called the carry axis.

In general, the bag is substantially symmetrical with respect to a midplane located between the two shoulder straps.

According to an exemplary embodiment of the invention, the dorsal carry assist device comprises a sling for carrying said bag, said sling being intended to clasp a portion of the bag and the hips of said individual; and a means for removable retention of the carry sling to said bag.

According to an exemplary embodiment of the invention, the carry assist device assists dorsal carrying of a backpack-type or satchel-type bag by an individual. The bag comprises a pair of shoulder straps. The carry assist device comprises a carry sling to carry the bag and a retaining slip to removably retain the carry sling to the bag. The carry sling is configured to clasp a portion of the bag and hips of the individual, without clasping the bag entirely. The retaining sling comprises a fastener to open and close the retaining sling. The carry assist device is removable from the bag. When the retaining sling is closed, the retaining sling forms together with a central portion of the carry sling a loop which is configured to clasp entirely a lower portion of the bag when it is carried according to a carry axis.

Thus, the shoulders of the individual carrying the bag are relieved because the weight of the bag is taken up at least in part by the carry sling which generally clasps the hips of the individual by pressing the bag into the bottom of the back of the individual.

The carry sling, which generally runs in the lower portion of the bag opposite the bottom of the back at the time of carrying, allows shifting all or part of the load from the shoulders to the lumbar and abdominal regions of the individual carrying the bag with the carry assist device.

It should be pointed out that the carry assist device is not permanently attached to the bag as could be the case with a ventral sling of a hiking bag, but removably in order to enable storing thereof when it is no longer used, thus reducing the overall bulk of the bag.

Furthermore, the removable carry assist device could be easily installed on another bag.

In addition, the carry sling surrounding the bag and pressing the bottom of the bag against the bottom of the back, an over-centering effect is obtained, pressing the bag more firmly against the back than does a ventral sling integrated to said bag.

It is to be noted that the carry sling is configured to clasp a portion of the bag and the hips of the individual, without clasping the bag entirely. In particular, the portion of the bag may be a lower portion of the bag, when carried according to a carry axis.

This means that, considering the bag having a so-called back part, which is configured to be in contact with the individual's back when the bag is carried according to a carry axis, the back-part of the bag is not clasped by the carry sling.

In other words, the carry sling, when closed, is configured to form a loop which clasps merely a portion of the bag, and the hips or waist of the individual.

Furthermore, when the retaining sling is closed, the retaining sling forms together with a central portion of the carry sling a loop which is configured to clasp entirely a lower portion of the bag when it is carried according to a carry axis.

This means that the retaining sling and the central portion of the carry sling are configured to form a closed loop entirely encircling the lower portion of the bag.

In other words, when both the carry sling and the retaining sling are closed, the carry sling forms a greater loop surrounding the hips of the individual and a portion of the bag, but not all of its perimeter, and the retaining sling together with the central portion of the carry sling forms another smaller loop within the greater loop, surrounding entirely the perimeter of the portion of the bag.

The features recited hereabove allow to press or tackle the lower portion of the bag against the individual's back when the bag is carried, thanks to the carry sling as described. This also allows the bag to "arch" against the individual's back and relieve the individual's shoulder from a weight carried in the bag. The retaining sling plays an important role for retaining the carry sling on the bag and allows it to fulfil its function.

It is also to be noted that the carry sling is different from a so-called ventral strap, which may be part of the backpack and attached permanently to it, but which doesn't allow to obtain the above-mentioned effects.

This effect can be enhanced in advantageous, but optional embodiments, in which the carrying sling includes a means for adjusting its length, which thus allows to clasp tightly the carrying sling around the hips and the portion of the bag.

In particular embodiments of the invention, the means for retaining the carry sling to said bag comprises:

- a retaining sling including two strands each hooked to the carry sling equidistant from a point substantially at the middle of the carry sling, each end of the retaining sling comprising a complementary closure means; and
- a means for setting the length of at least one of the portions of the retaining sling.

In particular embodiments of the invention, the means for setting the length of one of the portions of the retaining sling is elastic.

In particular embodiments of the invention, the device also comprises a means for stabilizing the inclination of the bag with respect to the back of an individual carrying said bag with said device for assisting the back carrying.

Thus, the bag is stabilized in inclination with respect to the back of the individual, which allows holding thereof during the movements made by the individual who can walk or run without any particular discomfort. Furthermore, this improved stability prevents the individual being thrown back by tilting of the bag away from the back of the individual.

In particular embodiments of the invention, the means for stabilizing the inclination of the bag is a central section of the carry sling which has a width larger than that of the other sections of the carry sling.

In particular embodiments of the invention, the means for stabilizing the inclination of the bag is a sling, called a stabilizing sling, attached at each of its ends to points on the carry sling, called attach points, the stabilizing sling having substantially the same length as the central portion of the carry sling, said central portion being comprised between said attach points.

The stabilizing sling allows duplicating the carry sling, thus increasing the retaining points of the bag. The stabilizing sling generally clamps the bag in an area higher than the carry sling which supports the lower portion of the bag when the bag is naturally carried by the individual.

In particular embodiments of the invention, the angle between the central portion of the carry sling and the stabilizing sling is comprised between 10 and 60 degrees.

In particular embodiments of the invention, the width of the carry sling is larger than or equal to the width of the stabilizing sling, the width of the retaining sling being smaller than the width of the stabilizing sling.

In particular embodiments of the invention, the carry sling comprises means for quick closure and length setting of the carry sling.

Advantageously, the carry sling comprises a closure buckle and two setting buckles, located on either side of the closure buckle.

Thus, with two setting buckles, it is possible to tighten the carry sling symmetrically, in particular to avoid destabilizing the position of the device with respect to the bag upon an action of tightening the carry sling of the bag around the hips of the individual.

In particular embodiments of the invention, the central portion of the carry sling forms an angle comprised between 10 and 60 degrees with the rest of the carry sling.

In particular embodiments of the invention, the carry sling is made of high-density polypropylene fiber.

In particular embodiments of the invention, the carry sling comprises at least two so-called lateral pads adapted to be pressed on the hips of the individual carrying the bag.

In particular embodiments of the invention, the retaining sling comprises at least one so-called dorsal pad adapted to be pressed on the bottom of the back of the individual carrying the bag.

The invention also relates to a method for installing a carry assist device according to any one of the preceding embodiments, on a bag comprising a pair of shoulder straps enabling a dorsal carrying of the bag by an individual according to a so-called carry axis, each shoulder strap being attached to the bag on either side of the carry axis.

Such an installation method comprises steps of:

- closure of the retaining sling by clasping a portion of the bag with the central portion of the carry sling;
- positioning of the bag on the back of the individual by putting on the shoulder straps of said bag; and
- closure of the carry sling substantially clasping the hips of the individual.

Thus, the individual carrying the bag on his back is relieved by the dorsal carry assist device which shifts a portion of the weight from his shoulders to the lumbar and abdominal regions.

When closed, the retaining sling forms together with a central portion of the carry sling a loop which clasps the portion of the bag, generally located opposite a handle for carrying the bag by hand. This portion of the bag corresponds to a lower portion of the bag when it is carried according to the carry axis.

Preferably, the carry sling substantially clasps the hips and the abdomen of the individual, a means for closing the carry sling being located at the level of the abdomen of the individual.

In particular implementations, the method also comprises prior to the step of positioning the bag on the back, a step of positioning a means for stabilizing the carry device in a middle portion of the bag.

In general, this middle portion is located between the upper portion of the bag where the handle is attached and the lower portion of the bag which is clasped by the carry sling.

BRIEF DESCRIPTION OF THE FIGURES

Other advantages, aims and particular features of the present invention will appear from the following non-limiting description of at least one particular embodiment of the devices and methods that are the objects of the present invention, with reference to the appended drawings, wherein.

DETAILED DESCRIPTION OF THE INVENTION

The present description is given without limitation, each feature of an embodiment could advantageously be combined with any other feature of any other embodiment.

From now on, it should be noted that the figures are not to scale.

Example of a Particular Embodiment

Figure 1:
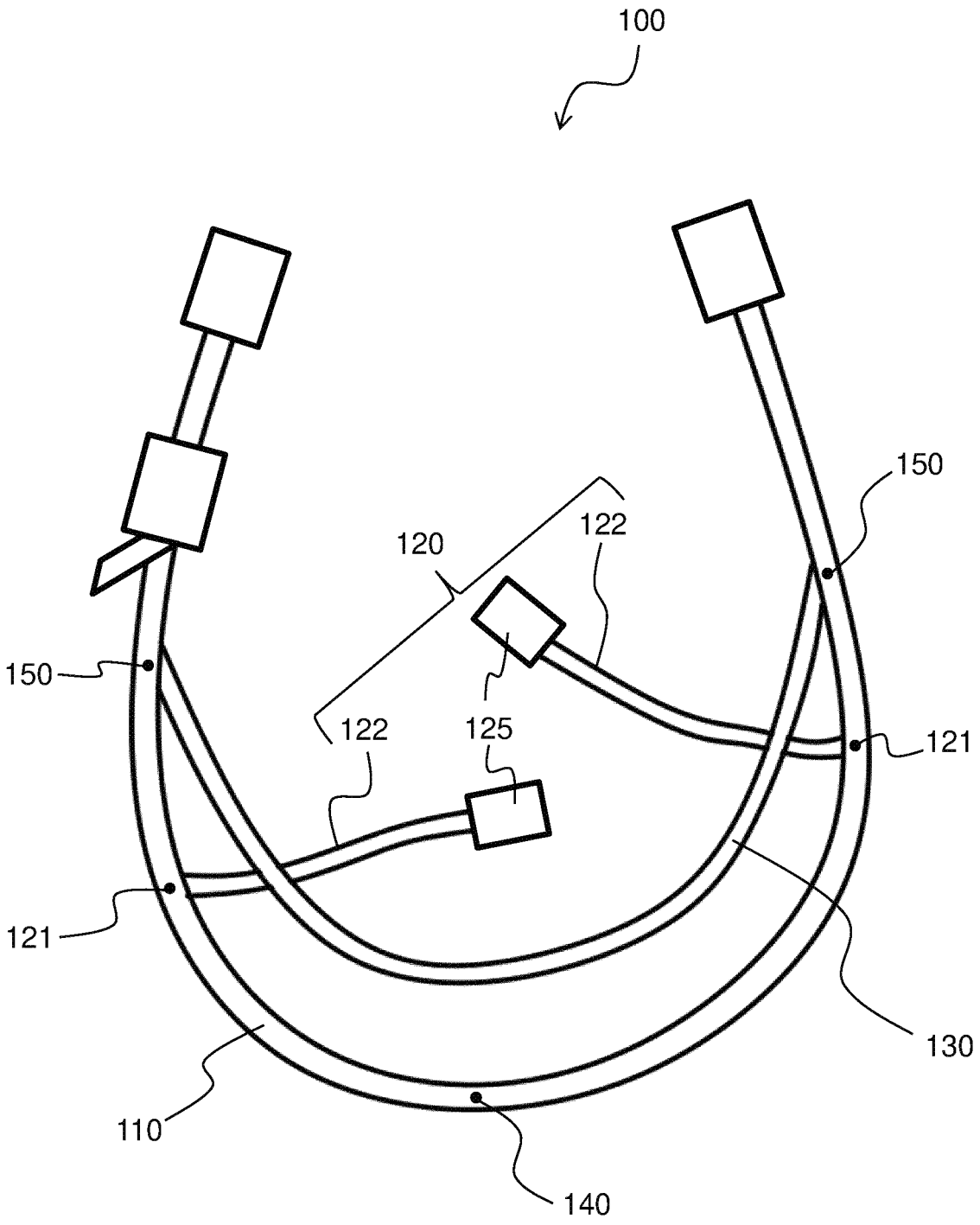
FIG. 1 is a schematic view of a dorsal carry assist device according to an embodiment of the invention.

FIG. 1 is a schematic view of a dorsal carry assist device 100 according to the invention.

The carry assist device 100 comprises a carry sling 110, a sling 120 for retaining the carry sling 110 to a bag, and a stabilizing sling 130. In the present non-limiting example of the invention, the three slings 110, 120 and 130 are made of high-density polypropylene fiber.

The strap 120 comprises two strands 122 each hooked at one of their ends to the carry sling 110 at a point 121 located equidistant from a substantially middle point 140 of the carry sling 110. In other words, the carry sling 110 is substantially symmetrical according to a midplane. Hooking of the strands 122 to the carry sling 110 is herein achieved by stitching but could be achieved by any other means known to a person skilled in the art.

In order to be able to easily install the carry assist device 100 on the bag, the retaining sling 120 includes a means for opening and closing the retaining sling 120 which herein comprises a closure buckle 125, including two complementary elements. The means for opening and closing the retaining sling 120 may also include clips or a clasp.

In turn, the stabilizing sling 130 is attached by sewing at each of its ends at points 150 of the carry sling 110. The points 150 lie on either side of the middle point 140, equidistant from the middle point 140. In general, the points 121 for attaching the strands 122 of the retaining sling 120 lie between the points 150 for attaching the stabilizing sling 130 to the carry sling 110 and the middle point 140. Nonetheless, the points 121 and 150 may advantageously be combined in order to reduce the number of seams made.

In some variants of this particular embodiment of the invention, the points 150 lie between the points 121 and the middle point 140 to reduce the proportion of the slings in contact with the individual when carrying the bag on the back.

Figure 2:
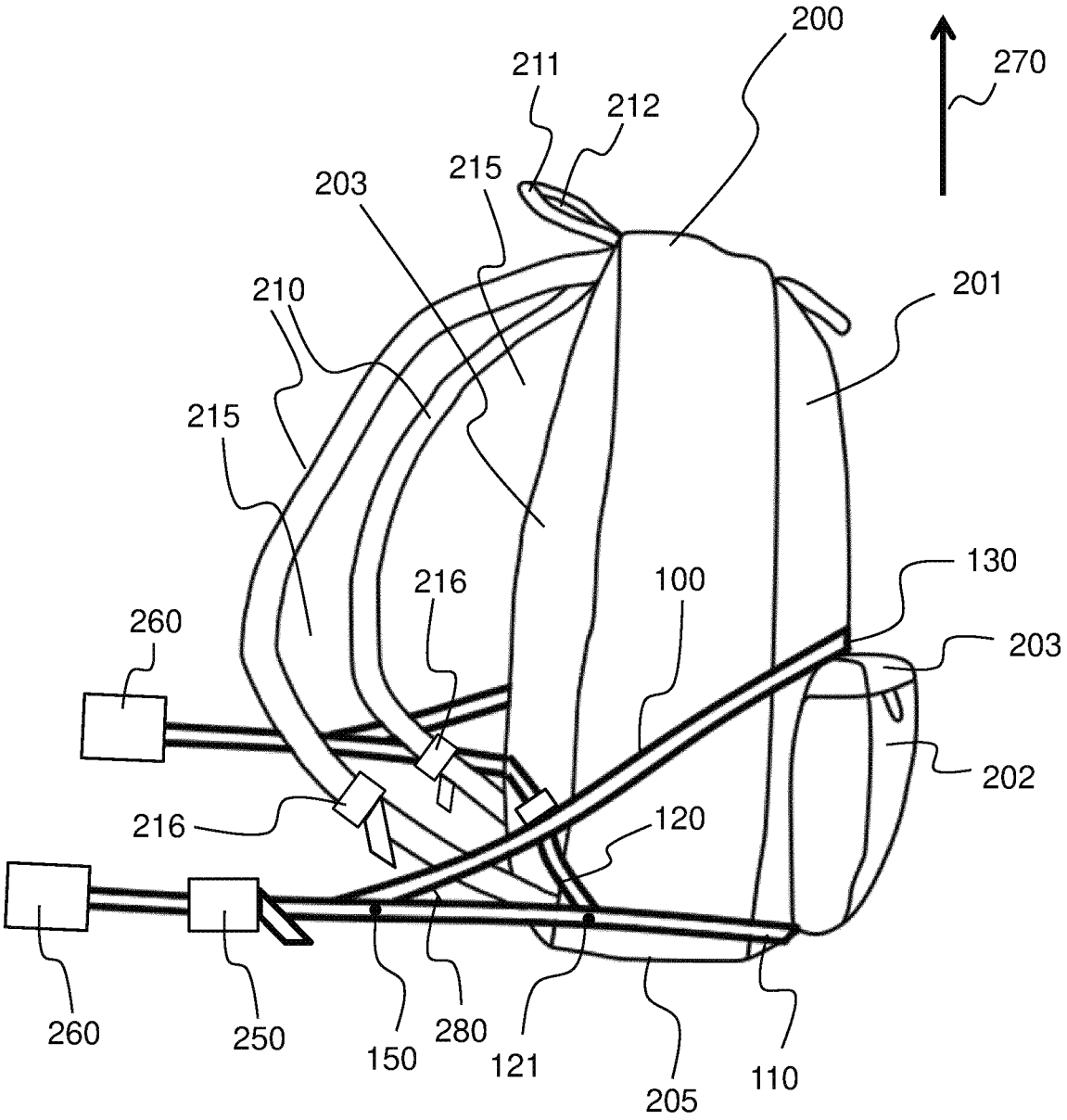
FIG. 2 is a perspective view of a bag on which is installed the dorsal carry assist device of FIG. 1.

FIG. 2 is a perspective view of the bag 200 on which the carry assist device 100 is installed. In the present non-limiting example of the invention, the bag 200 is a backpack conventionally used by students at the age of ten or eleven years old. The bag 200 comprises a large pocket 201 in which students generally insert the books and notebooks that they have to carry between their educational institution and their home. The bag 200 also comprises a small pocket 202 opposite the back 203 of the bag 200 for carrying small items, such as keys or pencils.

In order to be carried on the back of an individual and in particular that of a student, the bag 200 comprises a pair of shoulder straps 210. Each shoulder strap 210 is attached to the bag 200 substantially symmetrically with respect to a midplane corresponding substantially to a plane of symmetry of the bag 200. A handle 211 allowing carrying the bag 200 by hand is generally sewn in the upper portion of the bag 200, substantially at the center and in the midplane. Each shoulder strap 210 sewn on either side of the handle 211 is brought to rest on a distinct shoulder of the individual when the latter carries the bag 200 on his back. Thus, the bag 200 is oriented according to a carry axis 270 which is substantially vertical at the time of carrying. It should be pointed out that the carry axis 270 is substantially coincident with said plane of symmetry of the bag 200.

When installing the carry assist device 100 on the bag 200, the carry sling 110 runs in the lower portion of the bag 200 according to the carry axis 270 proximate to the bottom 205 of the bag 200 proximate to the small pocket 202. In turn, the stabilizing sling 130 runs in the middle portion of the bag, proximate to an opening 203 of the small pocket 202, thus leaving free access to the small pocket 202.

In order to retain the device 100 for assisting carrying of the bag 200 in position, the retaining sling 120 is advantageously inserted inside the opening 215 delimited by each shoulder strap 210 and then closed using the closure buckle 125. Thus, the shoulder straps 210 are free to move.

Advantageously, the retaining sling 120 is elastic in the present non-limiting example of the invention. Thus, once closed, the retaining sling 120 forms with the middle portion of the carry sling 110 a loop, whose circumference is smaller than the circumference of the bag 200. Thus, the elasticity of the strap 120 allows for a degree of freedom in length of the sling 120 while at the same time conferring a return force pressing the retaining sling 120 and the middle portion of the carry sling 110 against the bag 200.

In some variants of this particular embodiment of the invention, the retaining sling 120 comprises a length setting buckle besides the elasticity of the retaining sling 120. Such a length setting buckle may also enable a non-elastic retaining sling 120 to be tightened in order to press the retaining sling 120 against the bag 200.

Thus, whether the retaining sling 120 is elastic and/or provided with a length setting buckle, the device 100 fits to different types of backpacks. In general, the device 100 could be used on backpacks whose perimeter is comprised between forty and two hundred centimeters When the carry assist device 100 is installed on the bag 200, the bag 200 could be carried by the individual who fits each of his arms in an opening 215 of a distinct shoulder strap 210.

When the bag 200 is positioned on the back of the individual with each shoulder strap 210 resting on a distinct shoulder of the individual, the carry sling 110 could be adjusted to the circumference of the hip of the individual thanks to a length setting buckle 250 installed on the carry sling 110. Afterwards, the individual can close the carry sling 110 thanks to two complementary parts 260 of a closure buckle of the carry sling 110, located substantially at the level of the abdomen of the individual.

The carry sling 110, when closed in particular using the complementary parts 260, forms a greater loop which surrounds the individual's hips, and a portion of the bottom 205 of the bag 200, but not all of the bottom's circumference or perimeter, as it can be seen on FIG. 2.

The retaining sling 120 and a central portion of the carry sling 110, which here may be defined as the portion between points 121 without being limited thereto, together form a smaller loop when the retaining sling is closed, for example using the buckles 125, this smaller loop surrounding entirely the bottom 205 of the bag 200.

In other words, the smaller loop is formed within the greater loop, as it can also easily be inferred from FIG. 2.

The individual could then benefit from the carry assist of the device 100 which shifts a portion of the weight of the bag from the shoulders to the lumbar and abdominal regions of the individual, and in particular to the pelvis of the individual. Thus, the shoulders of the individual are relieved.

Figure 3:
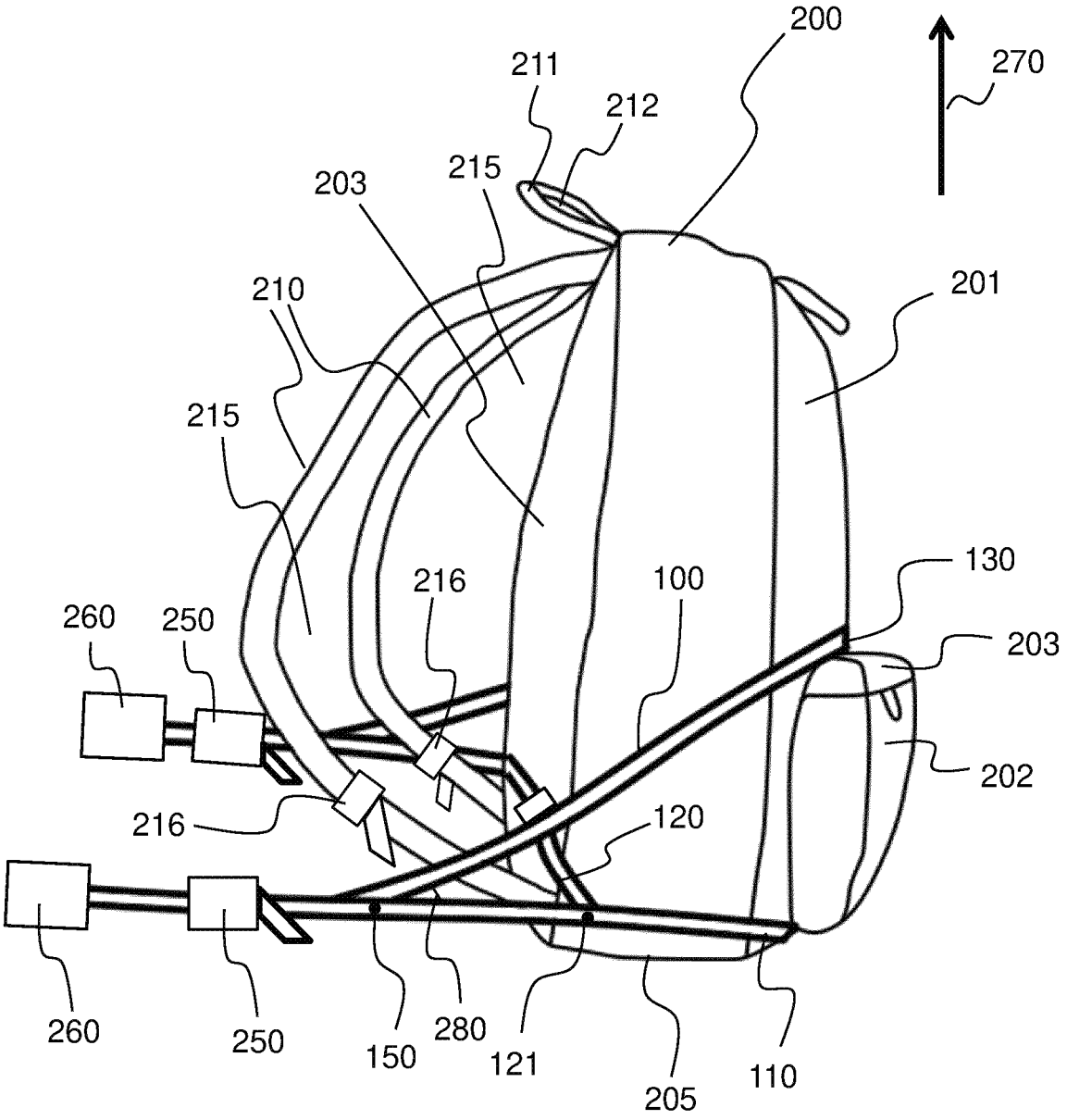
FIG. 3 is a perspective view of a bag on which is installed a variant of the previous dorsal carry assist device.

In some variants of this particular embodiment, illustrated in FIG. 3, the carry sling 110 comprises two length setting buckles 250 each located proximate to a complementary part 260 distinct from the closure buckle. Thus, the user can adjust the length of the carry sling 110 symmetrically without any risk of destabilizing the relative position of the carry assist device 100 with respect to the bag 200.

It should be pointed out that the shoulder straps 210 of the bag 200 generally comprise a length setting buckle 216. The individual carrying on his back the bag 200 on which the carry assist device 100 is installed can adjust the amount of load shifted from the shoulders to the lumbar and abdominal regions by tightening the shoulder straps 215 more or less by means of the length setting buckles 216. Thus, it is possible to rest all the load of the bag 200 on the lumbar and abdominal regions by loosening the length setting buckles 216, which induces an increase in the length of each shoulder strap 215. Conversely, when the length setting buckles 216 are tightened, equivalent to reducing the length of each shoulder strap 215, the load carried by the shoulders of the individual increases.

Moreover, the stabilizing sling 130 allows keeping the bag substantially parallel to the back of the individual, thereby preventing the bag 200 from tipping backward as the individual moves. Thus, the individual could walk or run without any risk while carrying the bag 200 with the dorsal carry assist device 100.

Advantageously, the stabilizing sling 130 may be adjustable in length, for example using a tightening buckle, located for example at the junction between the stabilizing sling 130 and the carry sling 110. In this way, the stabilizing sling 130 could be adapted to different backpacks, having various shapes and therefore requiring adaptability of the stabilizing sling 130.

It should be noted that the stitching points 150 of the carry sling 110 are in the present non-limiting example of the invention remote from the points 121 thus improving the stabilization of the bag by reducing the angle 280 formed between the sling 110 and the sling 130. The angle 280 is herein in the range of 20°.

It should be pointed out that when the carry assist device 100 is removed off the bag 200, the carry assist device 100 is compactable in a pocket the dimensions of which are in the range of 10×6 cm. The carry assist device 100 could then be easily stored in the small pocket 202 of the bag 200.

The carry assist device 100 could also be hooked to the handle 211 of the bag 200 by passing for example a portion of the carry sling 110, opened beforehand, inside an opening 212 delimited by the handle 211 which is herein formed by a sling, then by closing the carry sling 110 through the complementary parts 260.

Figure 4:
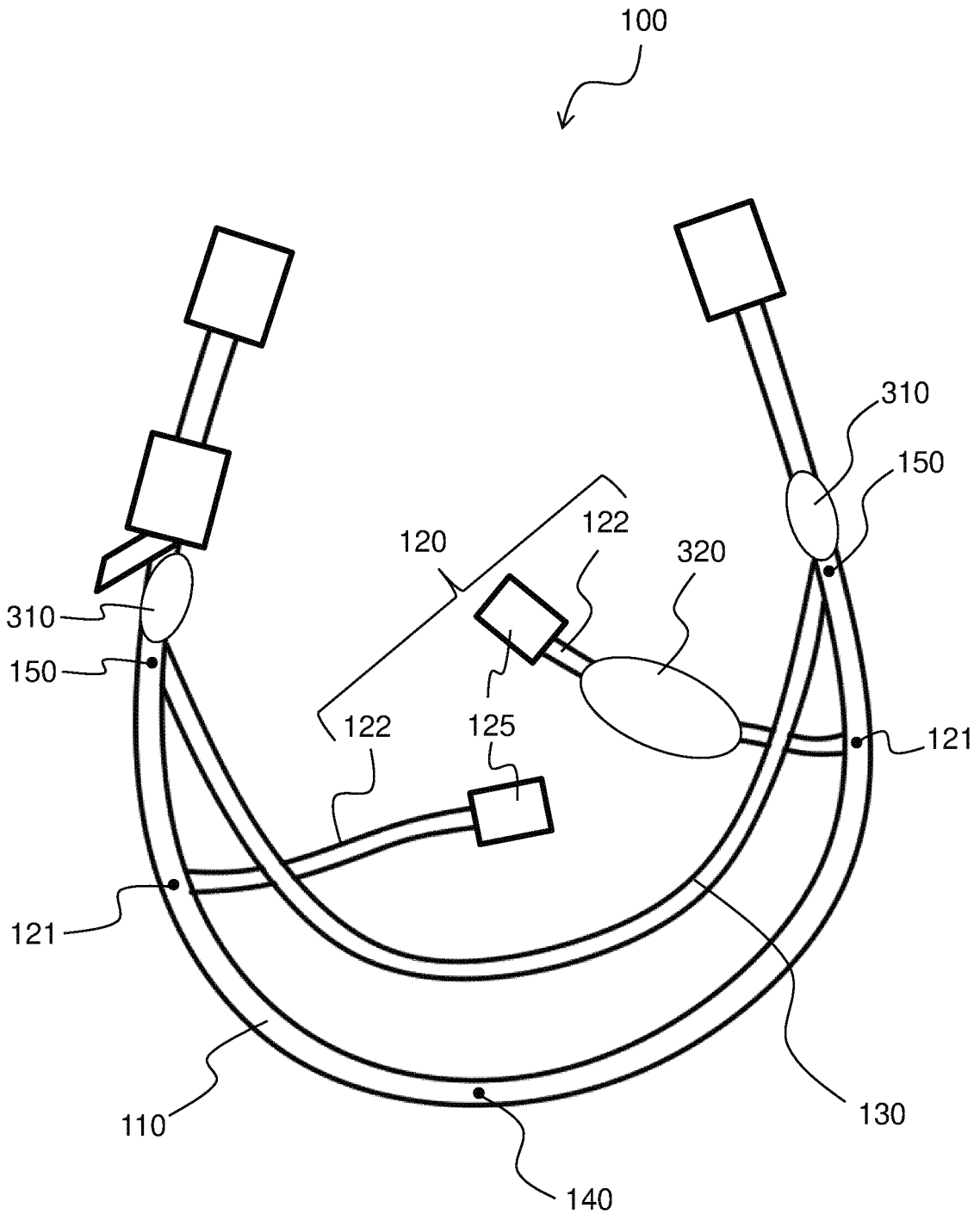
FIG. 4 is a schematic view of another variant of the dorsal carry assist device comprising two lateral pads and a dorsal pad.

Optionally, the carry sling 110 may include lateral pads 310, represented in FIG. 4, which are positioned at the level of the hips in order to contribute to the comfort of carrying the bag 200.

In some variants, such pads could also be retained at the level of the back of the individual by the retaining sling 120. It should be noted that when a pad is installed on the retaining sling 120, this pad, of the dorsal or lumbar type, could rest on the coccyx, thus contributing to assisting carrying of the bag 200.

Thus, optionally, the retaining sling 120 comprises at least one dorsal or lumbar pad 320, represented in FIG. 4, intended to be positioned on the lumbar and more generally the bottom of the back of the individual carrying the bag, in order to dampen the impact of the bag against the back, as well as to prevent rubbing of the bag against the back.

Preferably, such a dorsal or lumbar pad 320 is inflatable, so as to limit bulk when the lumbar pad is not in use. In an inflated state, the lumbar pad 320 has a thickness comprised between 2 to 4 centimeters, corresponding to the distance separating the bag from the back of the individual carrying the bag in this inflated state.

Thus, the lumbar pad 320 also allows for a better circulation of air in comparison with a retaining sling 120 without a lumbar pad.

In order to improve the circulation of air between the bag and the back of the individual carrying the bag, the lumbar pad 320 may be structured. For example, such a structure consists of a series of reliefs or crenellations.

It is provided for the lumbar pad 320 being able to be secured to the retaining sling 120 either permanently or removably, for example by slipping over the retaining sling 120 using loops.

Another Exemplary Embodiment

Figure 5:
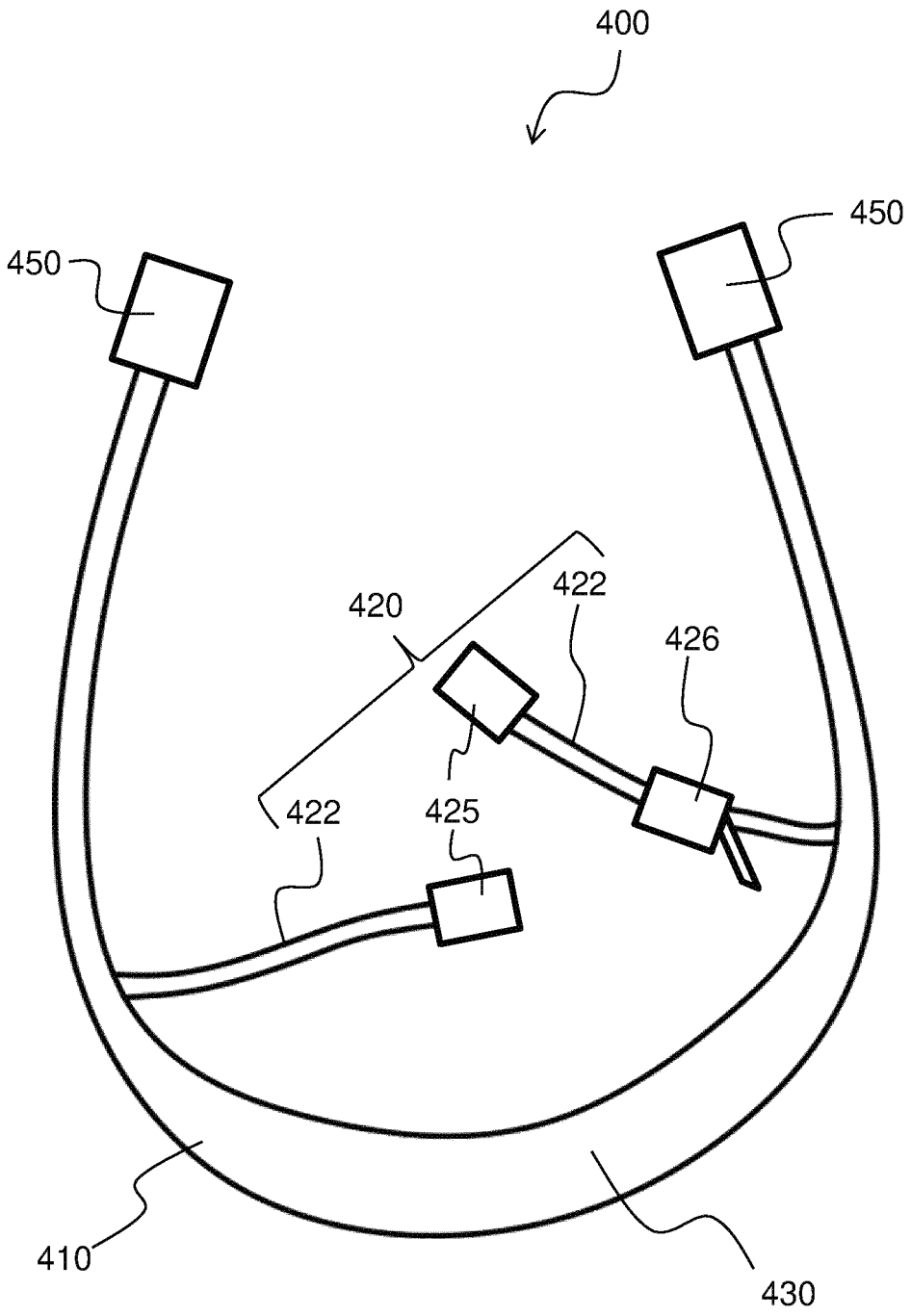
FIG. 5 is a schematic view of a dorsal carry assist device according to another embodiment of the invention.

FIG. 5 is a schematic view of a dorsal carry assist device 400 according to the invention.

In the present non-limiting example of the invention, the dorsal carry assist device 400 comprises a carry sling 410 intended to clasp a portion of a bag including a pair of shoulder straps (not represented in FIG. 5), and a sling 420 for retaining the carry sling 410 to the bag.

Advantageously, the carry sling 410 herein comprises a central section 430 allowing stabilizing the bag during dorsal carrying. The central section 430 has a larger width than the rest of the carry sling 410.

In some variants of this particular embodiment of the invention, the width of the carry sling 410 is constant all over the sling, thus reducing the stabilization of the carried bag.

The sling 410 also comprises opening and closure means 450 so that the sling 410 could be clasped around the waist or the hips of an individual.

The retaining sling 420 comprises two strands 422 each including at one of their ends complementary parts 425 allowing quick opening and closure of the sling 420, and a length setting buckle 426 in order to adjust the size of the sling 420 to the dimensions of the bag.

When the carry assist device 400 is installed on the bag itself carried by an individual, carrying of the bag is stabilized thanks to the central section 430 of the carry sling 410 which is wider than the rest of the sling 410.

The invention claimed is:

1. A carry assist device to assist dorsal carrying of a backpack-type or satchel-type bag by an individual, the bag comprising a pair of shoulder straps, the carry assist device comprising:

a carry sling to carry the bag, the carry sling being configured to clasp a lower portion of the bag and hips of the individual, without clasping the bag entirely;

a retaining sling to removably retain the carry sling to said bag, the retaining sling comprising a fastener to open and close the retaining sling;

wherein carry assist device being removable from the bag;

wherein, when the retaining sling is closed, the retaining sling forms together with a central portion of the carry sling a loop which is configured to clasp entirely a lower portion of the bag when it is carried according to a carry axis; and wherein the carry sling comprises a closure buckle and two setting buckles located on either side of the closure buckle.

2. The carry assist device of claim 1, wherein the retaining sling comprises:

two strands, each hooked to the carry sling equidistant from a point at the middle of the carry sling, each end of the retaining sling comprising a complementary closure; and a length adjuster to adjust and set a length of at least one of sections of the retaining sling.

3. The carry assist device of claim 2, wherein the length adjuster elastically adjusts and sets the length of said at least one of sections of the retaining sling.

4. The carry assist device of claim 1, further comprising a stabilizer to stabilize an inclination of the bag with respect to a back of the individual carrying the bag with the carry assist device.

5. The carry assist device of claim 4, wherein a central section of the carry sling comprises the stabilizer, a width of the central section is larger than a width of other sections of the carry sling.

6. The carry assist device of claim 4, wherein the stabilizer is a stabilizing sling and the carry sling comprises attach points, each end of the stabilizing sling is attached to a different attach point on the carry sling, the stabilizing sling has a same length as the central section of the carry sling, the central section being comprised between the attach points.

7. The carry assist device of claim 6, wherein an angle between the central section of the carry sling and the stabilizing sling is between 10 and 60 degrees.

8. The carry assist device of claim 6, wherein a width of the carry sling is larger than or equal to a width of the stabilizing sling, a width of the retaining sling being smaller than the width of the stabilizing sling.

9. The carry assist device of claim 1, wherein the carry sling comprises a buckle for quick closure and length setting of the carry sling.

10. The carry assist device of claim 1, wherein the carry sling is made of high-density polypropylene fiber.

11. The carry assist device of claim 1, wherein the carry sling comprises at least two lateral pads configured to be pressed on the hips of the individual carrying the bag.

12. The carry assist device of claim 1, wherein the retaining sling comprises at least one dorsal pad configured to be pressed on a lower back of the individual carrying the bag.

13. A method for installing the carry assist device on the bag comprising the pair of shoulder straps to enable the dorsal carrying of the bag by the individual, each shoulder strap being attached to the bag on either side of a midplane of the bag, the carry assist device comprising:

a carry sling to carry the bag, the carry sling being configured to clasp a lower portion of the bag and hips of the individual, without clasping the bag entirely;

a retaining sling to removably retain the carry sling to said bag, the retaining sling comprising a fastener to open and close the retaining sling;

wherein carry assist device being removable from the bag; and wherein, when the retaining sling is closed, the retaining sling forms together with a central portion of the carry sling a loop which is configured to clasp entirely a lower portion of the bag when it is carried according to a carry axis;

the method comprising:

closure of the retaining sling by clasping the portion of the bag with a central section of the carry sling;

positioning the bag on a back of the individual by putting on the shoulder straps of said bag; and closure of the carry sling by clasping the hips of the individual.

14. A carry assist device to assist dorsal carrying of a backpack-type or satchel-type bag by an individual, the bag comprising a pair of shoulder straps, the carry assist device comprising:

a carry sling to carry the bag, the carry sling being configured to clasp a portion of the bag and hips of the individual, without clasping the bag entirely;

a retaining sling to removably retain the carry sling to said bag, the retaining sling comprising a fastener to open and close the retaining sling;

a stabilizer to stabilize an inclination of the bag with respect to a back of the individual carrying the bag with the carry assist device;

wherein carry assist device being removable from the bag;

wherein, when the retaining sling is closed, the retaining sling forms together with a central portion of the carry sling a loop which is configured to clasp entirely a lower portion of the bag when it is carried according to a carry axis; and wherein the stabilizer is a stabilizing sling and the carry sling comprises attach points, each end of the stabilizing sling is attached to a different attach point on the carry sling, the stabilizing sling has a same length as the central section of the carry sling, the central section being comprised between the attach points.

* * * * *